US009881530B2

(12) United States Patent
Kim et al.

(10) Patent No.: US 9,881,530 B2
(45) Date of Patent: Jan. 30, 2018

(54) METHOD FOR REPRESENTING VISIBLE AREA OF THEATER

(71) Applicant: CJ CGV CO., LTD., Seoul (KR)

(72) Inventors: Hwan Chul Kim, Seoul (KR); Su Ryeon Kang, Goyang-si (KR); Jihyung Kang, Hwaseong-si (KR)

(73) Assignee: CJ CGV CO., LTD., Seoul (KR)

( * ) Notice: Subject to any disclaimer, the term of this patent is extended or adjusted under 35 U.S.C. 154(b) by 453 days.

(21) Appl. No.: 14/558,007

(22) Filed: Dec. 2, 2014

(65) Prior Publication Data

US 2015/0161924 A1 Jun. 11, 2015

(30) Foreign Application Priority Data

Dec. 9, 2013 (KR) ..... 10-2013-0152584

(51) Int. Cl.
*G09G 3/00* (2006.01)

(52) U.S. Cl.
CPC ..... *G09G 3/003* (2013.01); *G09G 2300/026* (2013.01); *G09G 2320/028* (2013.01); *G09G 2320/068* (2013.01)

(58) Field of Classification Search
CPC .. H04N 9/3147; H04N 9/3185; H04N 9/3194; G09G 2300/026; G09G 3/003; G09G 2320/028; G09G 2320/068; E04H 3/22; G06F 3/1446; G03B 21/147; G03B 37/04
USPC ..... 345/1.3
See application file for complete search history.

(56) References Cited

U.S. PATENT DOCUMENTS

| | | | | |
|---|---|---|---|---|
| 5,502,481 | A | 3/1996 | Dentinger et al. | |
| 2003/0234909 | A1* | 12/2003 | Collender | G03B 25/00 353/7 |
| 2005/0024722 | A1 | 2/2005 | Agostinelli et al. | |
| 2005/0041219 | A1 | 2/2005 | Streid et al. | |
| 2006/0291052 | A1 | 12/2006 | Lipton et al. | |
| 2007/0193123 | A1 | 8/2007 | Magpuri | |
| 2011/0216288 | A1* | 9/2011 | Rutledge | H04N 9/3185 353/70 |
| 2012/0236118 | A1 | 9/2012 | Tsai et al. | |
| 2013/0038702 | A1 | 2/2013 | Schweitzer et al. | |
| 2014/0016100 | A1* | 1/2014 | Kim | G03B 37/04 353/30 |

FOREIGN PATENT DOCUMENTS

| | | |
|---|---|---|
| CN | 1577050 A | 2/2005 |
| CN | 102523479 | 6/2012 |
| JP | 2002350999 | 12/2002 |

(Continued)

OTHER PUBLICATIONS

International Search Report for PCT/KR2014/011863 dated Feb. 9, 2015.

(Continued)

*Primary Examiner* — Christina Riddle
*Assistant Examiner* — Christopher Lamb, II
(74) *Attorney, Agent, or Firm* — Hauptman Ham, LLP

(57) ABSTRACT

Disclosed herein is a method of representing the visible area of a theater. The method may include generating a value of an angle at which a specific spot is seen from a reference spot within the theater and representing the visible area of the theater based on the value of the angle.

9 Claims, 9 Drawing Sheets

(56) References Cited

FOREIGN PATENT DOCUMENTS

| | | | |
|---|---|---|---|
| JP | 2007-536051 | A | 12/2007 |
| JP | 2008276102 | A | 11/2008 |
| JP | 2008281872 | A | 11/2008 |
| JP | 2008311766 | A | 12/2008 |
| JP | 4977278 | B1 | 4/2012 |
| KR | 1020130068623 | A | 6/2013 |
| WO | 2004/043075 | A1 | 5/2004 |
| WO | 2005/106161 | A1 | 11/2005 |

OTHER PUBLICATIONS

Japanese Office Action dated Aug. 22, 2017 in connection with the counterpart Japanese Patent Application No. 2016-537977.

* cited by examiner (A : First angle seen in horizontal direction
B : Second angle seen in vertical direction)

$$\cos A = \frac{b^2 + c^2 - a^2}{2bc}$$

$$\cos B = \frac{d^2 + f^2 - a^2}{2df}$$

METHOD FOR REPRESENTING VISIBLE AREA OF THEATER

CROSS REFERENCE TO RELATED APPLICATION

The present application claims the benefit of Korean Patent Application No. 10-2013-0152584 filed in the Korean Intellectual Property Office on Dec. 9, 2013, the entire contents of which are incorporated herein by reference.

BACKGROUND OF THE INVENTION

1. Technical Field

The present invention relates to a method of representing the visible area of a theater and, more particularly, to a method of representing the visible area of a theater based on the values of angles to a specific spot is seen from a reference spot within the theater.

2. Description of the Related Art

In order to provide audiences with a new three-dimensional effect and immersive experience, a so-called "multi-projection system" different from a known screening system based on a single screen is proposed.

The "multi-projection system" is a technology in which a plurality of projection surfaces is disposed on the periphery of stands (e.g., the front, the left, the right, the ceiling, and the bottom) and an image having a three-dimensional effect and immersive experience can be provided to audiences although a 3D technology is not applied to the image itself.

Such a multi-projection system may be constructed to have a different structure depending on the conditions of a theater because a plurality of projection surfaces is disposed in various directions around stands. More specifically, a plurality of projection surfaces disposed in each theater may have different disposition angles, different areas, etc. depending on the conditions of the theater. Accordingly, the visible area of a theater (i.e., an area where audiences are able to obtain visual information) may be different.

Accordingly, information about the visible area of each theater needs to be taken into consideration in a process of generating the video content of the theater in which such a multi-projection system has been constructed. Furthermore, information about all the visible areas of a theater needs to be taken into consideration in a process of generating "standard image content" that may be played back in all the theaters in each of which the multi-projection system has been constructed.

Accordingly, there is a need for a technology for managing information about the visible area of each theater, but such a technology is not present in a conventional system based on a single projection surface.

Accordingly, there is a need for the development of a technology in which information about the visible area of a theater may be managed and used.

The present invention has been invented based on such a technical background and also has been invented to satisfy the aforementioned technical need and to provide additional technical elements that may not be easily invented by those skilled in the art to which the present invention pertains. Accordingly, the present invention should not be construed as being limited by the technical background.

SUMMARY OF THE INVENTION

An object of the present invention is to manage and use information about the visible area of a theater.

Another object of the present invention is to represent the visible area of each theater using the values of angles with respect to a reference spot within the theater.

A method of representing the visible area of a theater in accordance with an embodiment of the present invention includes generating the value of an angle at which a specific spot is seen from a reference spot within the theater and representing the visible area of the theater based on the value of the angle.

Furthermore, in the method of representing the visible area of a theater in accordance with an embodiment of the present invention, generating the value of the angle may include generating the value of a first angle at which a specific spot is horizontally seen from a reference spot within the theater and generating the value of a second angle at which a specific spot is vertically seen from the reference spot within the theater.

Furthermore, in the method of representing the visible area of a theater in accordance with an embodiment of the present invention, the value of the first angle may be a value belonging to a range of −180 degrees to 180 degrees, and the value of the second angle may be a value belonging to a range of −90 degrees to 90 degrees.

Furthermore, in the method of representing the visible area of a theater in accordance with an embodiment of the present invention, representing the visible area of the theater may include representing the visible area on a coordinate system using the value of the first angle and the value of the second angle as variables.

Furthermore, the method of representing the visible area of a theater in accordance with an embodiment of the present invention may further include representing a standard visible area based on pieces of information about visible areas of a plurality of theaters.

Furthermore, in the method of representing the visible area of a theater in accordance with an embodiment of the present invention, the standard visible area may includes an area always seen in all of the plurality of theaters, an area always not seen in all of the plurality of theaters, and an area seen only in some of the plurality of theaters.

Furthermore, the method of representing the visible area of a theater in accordance with an embodiment of the present invention may further include generating a standard guide image used to produce standard content based on information about the standard visible area.

Furthermore, in the method of representing the visible area of a theater in accordance with an embodiment of the present invention, the theater may include a plurality of projection surfaces.

Such a method of representing the visible area of a theater in accordance with an embodiment of the present invention may be programmed and stored in a recording medium readable by an electronic device.

A theater information management apparatus in accordance with an embodiment of the present invention includes a visible area management unit configured to generate information about the visible area of a theater based on the value of an angle at which a specific spot is seen from a reference spot within the theater.

Furthermore, the visible area management unit of the theater information management apparatus in accordance with an embodiment of the present invention may generate the value of a first angle at which a specific spot is horizontally seen from a reference spot within the theater and generate the value of a second angle at which a specific spot is vertically seen from the reference spot within the theater.

Furthermore, the visible area management unit of the theater information management apparatus in accordance with an embodiment of the present invention may represent the visible area on a coordinate system using the value of the first angle and the value of the second angle as variables.

Furthermore, the visible area management unit of the theater information management apparatus in accordance with an embodiment of the present invention may generate information about a standard visible area based on pieces of information about visible areas of a plurality of theaters.

Furthermore, in the theater information management apparatus in accordance with an embodiment of the present invention, the standard visible area may include an area always seen in all of the plurality of theaters, an area always not seen in all of the plurality of theaters, and an area seen only in some of the plurality of theaters.

Furthermore, the theater information management apparatus in accordance with an embodiment of the present invention may further include a standard guide image generation unit configured to generate a standard guide image used to produce standard content based on information about the standard visible area.

DETAILED DESCRIPTION

Figure 1:
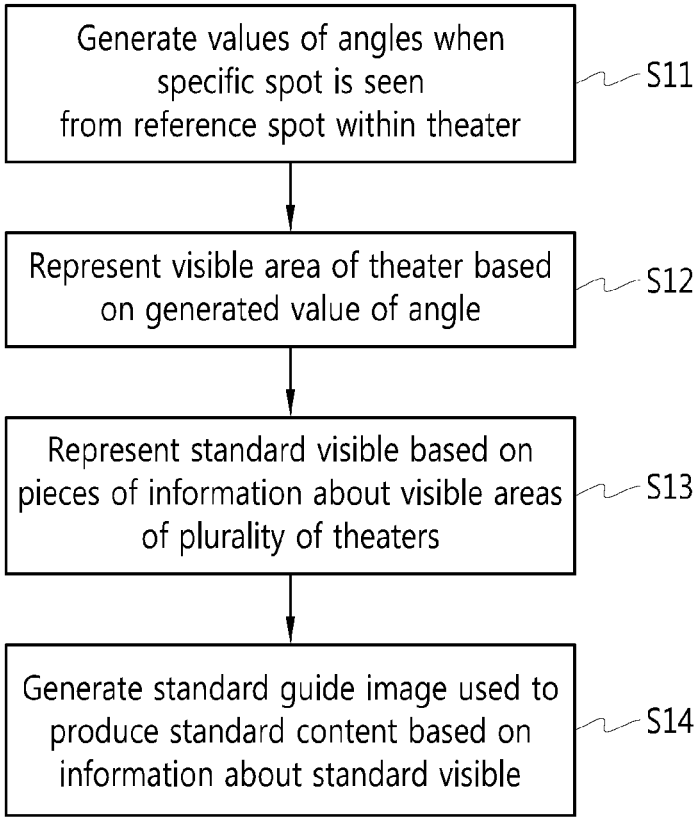
FIG. 1 is a flowchart illustrating a method of representing the visible area of a theater in accordance with an embodiment of the present invention.

Hereinafter, a method of representing the visible area of a theater and a theater information management apparatus using the same in accordance with embodiments of the present invention are described in detail with reference to the accompanying drawings. The embodiments to be described are provided in order for those skilled in the art to easily understand the technical spirit of the present invention, and the present invention is not limited to the embodiments. Furthermore, contents represented in the accompanying drawings have been diagrammed in order to easily describe the embodiments of the present invention, and the contents may be different from forms that are actually implemented.

Each of the elements represented herein is only an example for implementing the embodiments of the present invention. Accordingly, in other implementations of the present invention, different elements may be used without departing from the spirit and scope of the present invention. Furthermore, each element may be purely formed of a hardware or software element, but may also be implemented using a combination of various hardware and software elements that perform the same function.

Furthermore, an expression that some elements are "included" is an expression of an "open type", and the expression simply denotes that the corresponding elements are present, but it should not be understood that additional elements are excluded.

Furthermore, terms including ordinal numbers, such as the first and the second, may be used to describe various constituent elements, but the terms are used to only "distinguish" one constituent element from the constituent other element. The attributes of the constituent elements are not limited by the terms.

Furthermore, the method of representing the visible area of a theater to be described hereinafter in accordance with an embodiment of the present invention preferably may be used to represent the visible area of a theater in which a multi-projection system has been constructed, but is not limited thereto. That is, the method of representing the visible area of a theater in accordance with an embodiment of the present invention may be used in a known theater in which a plurality of projection surfaces has not been installed (i.e., a theater including only a single projection surface at the front) and may also be used in a variety of types of theaters including visible areas.

For reference, a "multi-projection system" described in this specification means a screening system including a plurality of projection surfaces. More specifically, the multi-projection system means a system in which a plurality of projection surfaces (e.g., the projection surfaces may be implemented in various forms, such as a screen, the surface of a wall, and the surface of an installation) is disposed on the periphery of stands and a screening environment having a three-dimensional effect and a high immersive experience is provided to audiences by projecting an image on the plurality of projection surfaces.

In this case, the plurality of projection surfaces may be implemented in various forms, such as a screen, the surface of a wall, the bottom, the ceiling, and the surface of an installation). Accordingly, the multi-projection system may be implemented in various forms, for example, 1) a system that uses a screen at the front, the surface of a wall on the left, and the surface of a wall on the right as projection surfaces, 2) a system that uses a screen at the front, the surface of a wall on the left, the surface of a wall on the right, and the surface of the bottom as projection surfaces, and 3) a system that uses the surface of a wall at the front, the surface of a wall on the left, the surface of a wall on the right, the surface of the bottom, and the surface of the ceiling as projection surfaces. In this case, the introduced systems are only illustrative, and the multi-projection system may be implemented in various forms using various projection surfaces.

Furthermore, the method of representing the visible area of a theater to be described hereinafter in accordance with an embodiment of the present invention preferably may be used to integrate and manage pieces of information about the visible areas of a plurality of theaters, but may be used in a process of managing information about the visible area of a single theater.

Furthermore, the "visible area" used in the present invention means an area where audiences may obtain visual information, preferably, an area on which an image is projected within a theater.

Furthermore, the method of representing the visible area of a theater to be described hereinafter in accordance with an embodiment of the present invention may be implemented through a cooperation operation between a variety of types of hardware and software. For example, the method of representing the visible area of a theater in accordance with an embodiment of the present invention may be implemented through the calculation operation of one or more server apparatuses and may be implemented through a cooperation operation between one or more server apparatuses and a variety of types of measurement apparatuses (e.g., sensors and distance measurement apparatuses).

Furthermore, the method of representing the visible area of a theater to be described hereinafter in accordance with an embodiment of the present invention may be programmed and stored in a recording medium that may be recognized by an electronic device.

Hereinafter, the method of representing the visible area of a theater in accordance with an embodiment of the present invention is described with reference to FIGS. 1 to 7.

Referring to FIG. 1, the method of representing the visible area of a theater in accordance with an embodiment of the present invention may include generating the values of angles when a specific spot is seen from a reference spot within a theater at step S11 and representing the visible area of a theater based on the value of the angle at step S12.

At step S11, the values of angles when a specific spot is seen from a reference spot within a theater are generated.

In this case, the reference spot is a reference point, that is, a basis for calculating the values of angles, and may be set in various ways according to a predetermined rule. The reference spot may be set in various ways, for example, as a point in the middle of stands, a point spaced apart from the center of a projection surface, disposed in front of stands, by a specific horizontal distance, a point set based on the structure surface of a theater (e.g., assuming that the distance between the surface of a wall at the front and the surface of a wall at the back is X, the distance between the surface of a wall on the left and the surface of a wall on the right is Y, and the distance between the bottom and the ceiling is Z, a point that is 0.3*X from the front, 0.5*Y from the surface of the wall on the left, and 0.3*Z from the bottom). In such a case, the reference spot preferably may be computed based on the databased structural data of a theater. The reference spot may be set based on input through a user interface and may be set through cooperation with a measurement apparatus for measuring a structure within a theater.

Furthermore, the specific spot means a spot included in a visible area of a theater. The specific spot may be derived based on the databased structural data of a theater or may be derived through cooperation with a measurement apparatus for measuring a structure within a theater. Furthermore, the specific spot may be derived based on input through a user interface.

Figure 2:
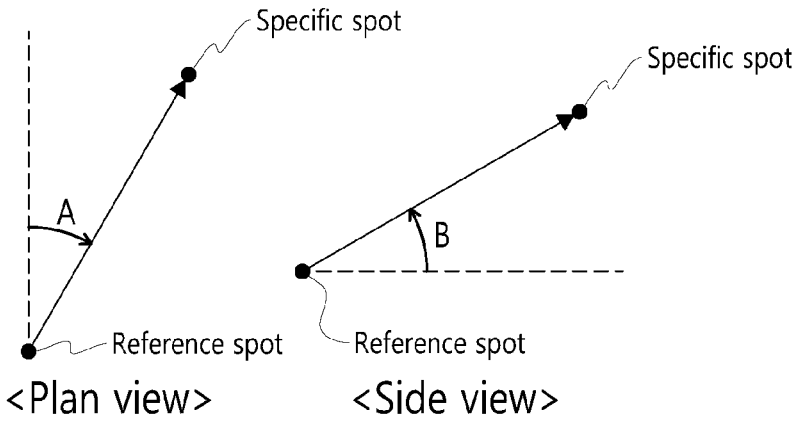
FIG. 2 is a conceptual diagram illustrating the value of a first angle at which a specific spot is horizontally seen from a reference spot within a theater and the value of a second angle at which a specific spot is vertically seen from the reference spot within the theater.
Figure 3:
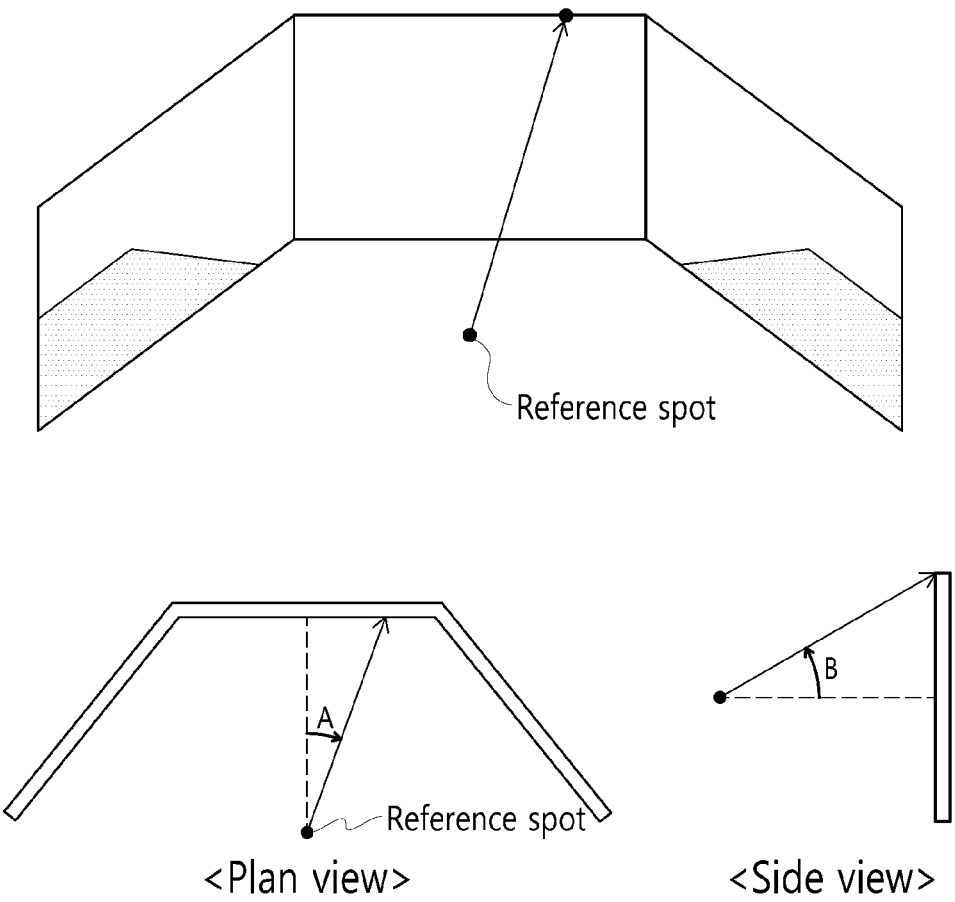
FIGS. 3 and 4 are exemplary diagrams illustrating the value of the first angle and the value of the second angle.
Figure 4:
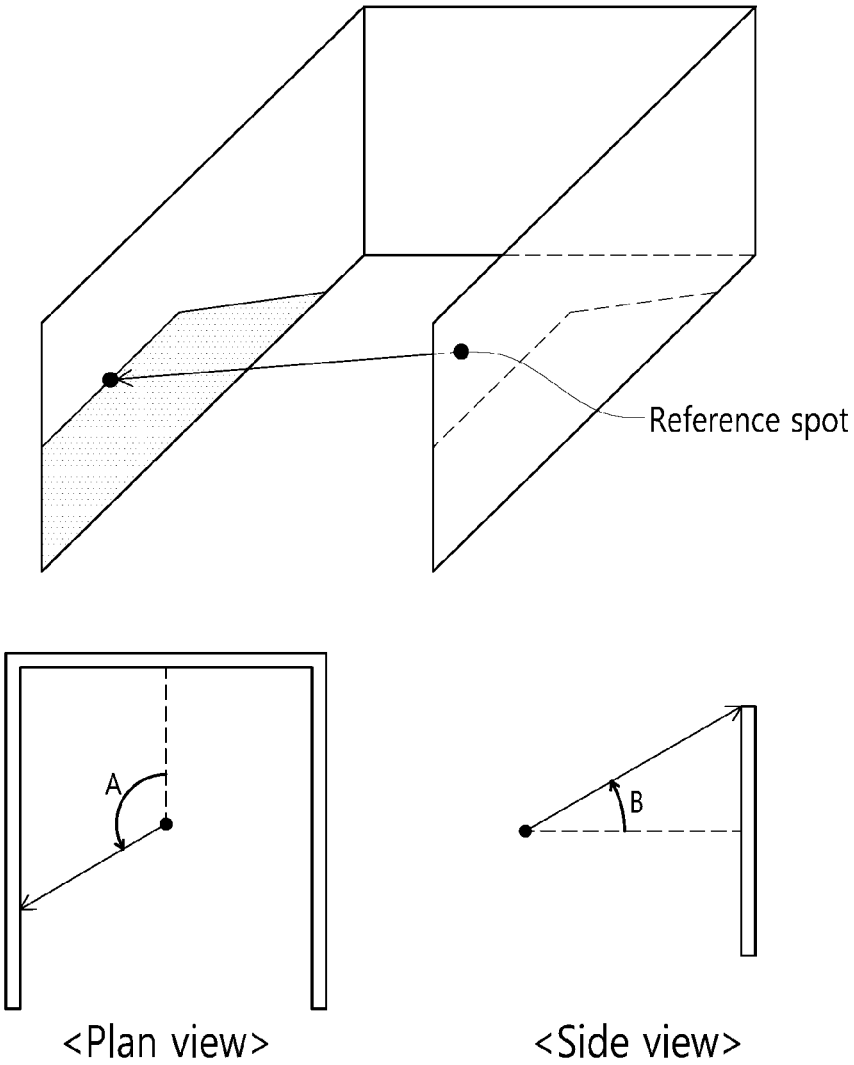
Figure 5:
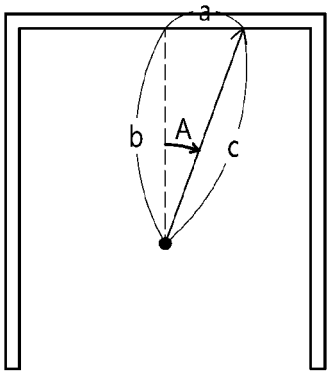
FIG. 5 is an exemplary diagram illustrating a method of calculating the value of the first angle and the value of the second angle.
Figure 5:
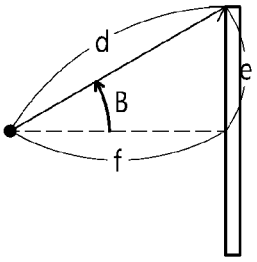

In an embodiment of the present invention, the value of an angle at which a specific spot is seen from a reference spot may be generated, and the specific spot may be represented. Furthermore, as illustrated in FIGS. 2 to 4, the value of a first angle A when a specific spot is seen from a reference spot in a horizontal direction and the value of a second angle B when a specific spot is seen from the reference spot in a vertical direction may be generated, and the specific spot may be represented. In such a case, the value of the first angle A may be a value belonging to a range of −180 degrees to 180 degrees, and the value of the second angle B may be a value belonging to a range of −90 degrees to 90 degrees. All the visible areas on a three dimension that are formed in a theater may be represented if the values of angles having such a range are used. Furthermore, the value of the first angle A and the value of the second angle B may be calculated using various methods, but preferably may be calculated through operation based on distance information. For example, as illustrated in FIG. 5, the value of the first angle A and the value of the second angle B may be calculated using information about the distance between the reference spot and the specific spot and a second cosine rule. For reference, the distance information may be generated based on the databased structural data of a theater or may be generated based on information generated by a measurement apparatus.

Step S11 preferably may be performed on a plurality of spots included in the visible area of a theater. In such a case, step S11 may be performed on all the spots included in the visible areas, but preferably may be performed on some sampled spots included in the visible area. Furthermore, the sampled spots preferably may be included in the outline of the visible area. If the visible area is visualized through step S12, the entire visible area may be sufficiently represented using only information about the outline of the visible area.

At step S12, the visible area of a theater is represented based on the values of angles generated at step S11. More specifically, at step S12, the visible area of the theater is represented using information about the values of angles when a plurality of spots included in the visible area is seen from a reference spot. In such a case, the visible area may be represented in the form of a visualized graph and preferably may be visualized through a coordinate system using the value of the first angle and the value of the second angle as variables.

Figure 6:
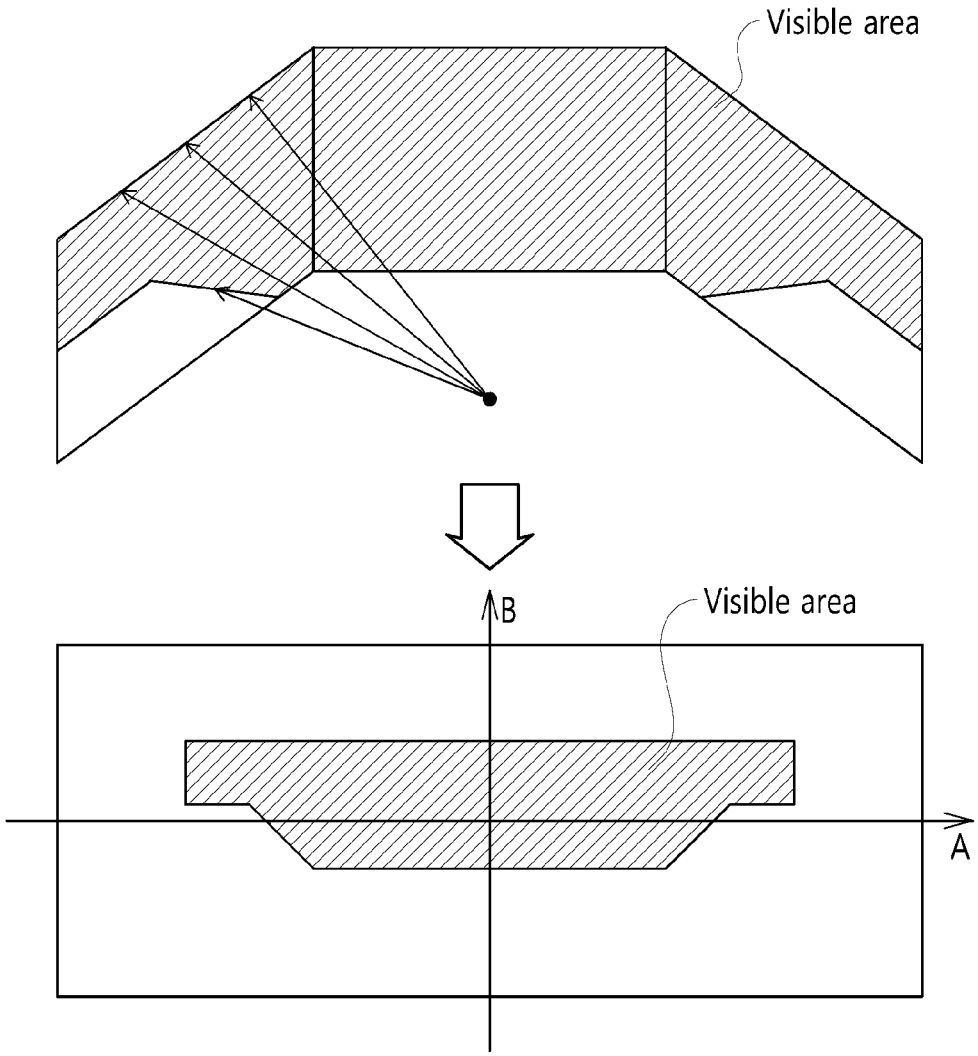
FIG. 6 is an exemplary diagram illustrating that visible areas are represent in a coordinate system using the value of the first angle and the value of the second angle as variables.

FIG. 6 illustrates an example in which the visible area of a theater has been represented through a coordinate system using the value of the first angle and the value of the second angle as variables. In the embodiment of FIG. 6, spots included in the visible area of a theater has been represented as a horizontal angle value (i.e., the value of the first angle A) and a vertical angle value (i.e., the value of the second angle B) with respect to the reference spot. The spots have been visualized on the coordinate system using the value of the first angle and the value of the second angle as variables based on the values of the angles.

As described above, in an embodiment of the present invention, the visible area of a specific theater may become a parameter and may be visualized and represented through step S11 and step S12. In particular, in an embodiment of the present invention, the visible area of a specific theater may be represented through 1) a process of specifying the visible area and sampling and extracting the outer spots of the visible area, 2) a process of generating the values of angles (i.e., the value of the first angle and the value of the second angle) when each of the sampled spots is seen from the reference spot, and 3) a process of visualizing and representing the values of the angles on a coordinate system (i.e., a coordinate system using the value of the first angle and the value of the second angle as variables).

Accordingly, in an embodiment of the present invention, an area within a theater may be divided into a visible area and an invisible area and the visible area and an invisible area may be managed through step S11 and step S12. In this case, as described above, the visible area means an area where audiences are able to obtain visual information and preferably may mean an area on which an image is projected within a theater. Furthermore, the invisible area means an area where audiences are unable to obtain visual information and may include a masking area and an area on which a projector does not perform projection.

Referring to FIG. 1, the method of representing the visible area of a theater in accordance with an embodiment of the present invention may further include representing a standard visible area based on pieces of information about the visible areas of a plurality of theaters at step S13 and generating a standard guide image used to produce standard content based on the information about the standard visible area at step S14.

Steps S11 and S12 correspond to a process of computing information about the visible area of each theater (i.e., computing information about the visible area of a theater 1, the visible area of a theater 2, the visible area of a theater 3, etc. by applying steps S11 and S12 to each of the theaters), whereas steps S13 and S14 correspond to a process of computing pieces of information in all aspects by combining pieces of information about the visible areas of a plurality of theaters.

At step S13, information about a standard visible area is computed by combining pieces of information about the visible areas of a plurality of theaters. In such a case, the pieces of information about the visible areas of the plurality of theaters preferably may be information represented in a coordinate system using the value of the first angle A and the value of the second angle B as variables. The standard visible area may be represented on the coordinate system by combining the pieces of information about the visible areas of the plurality of theaters.

Figure 7:
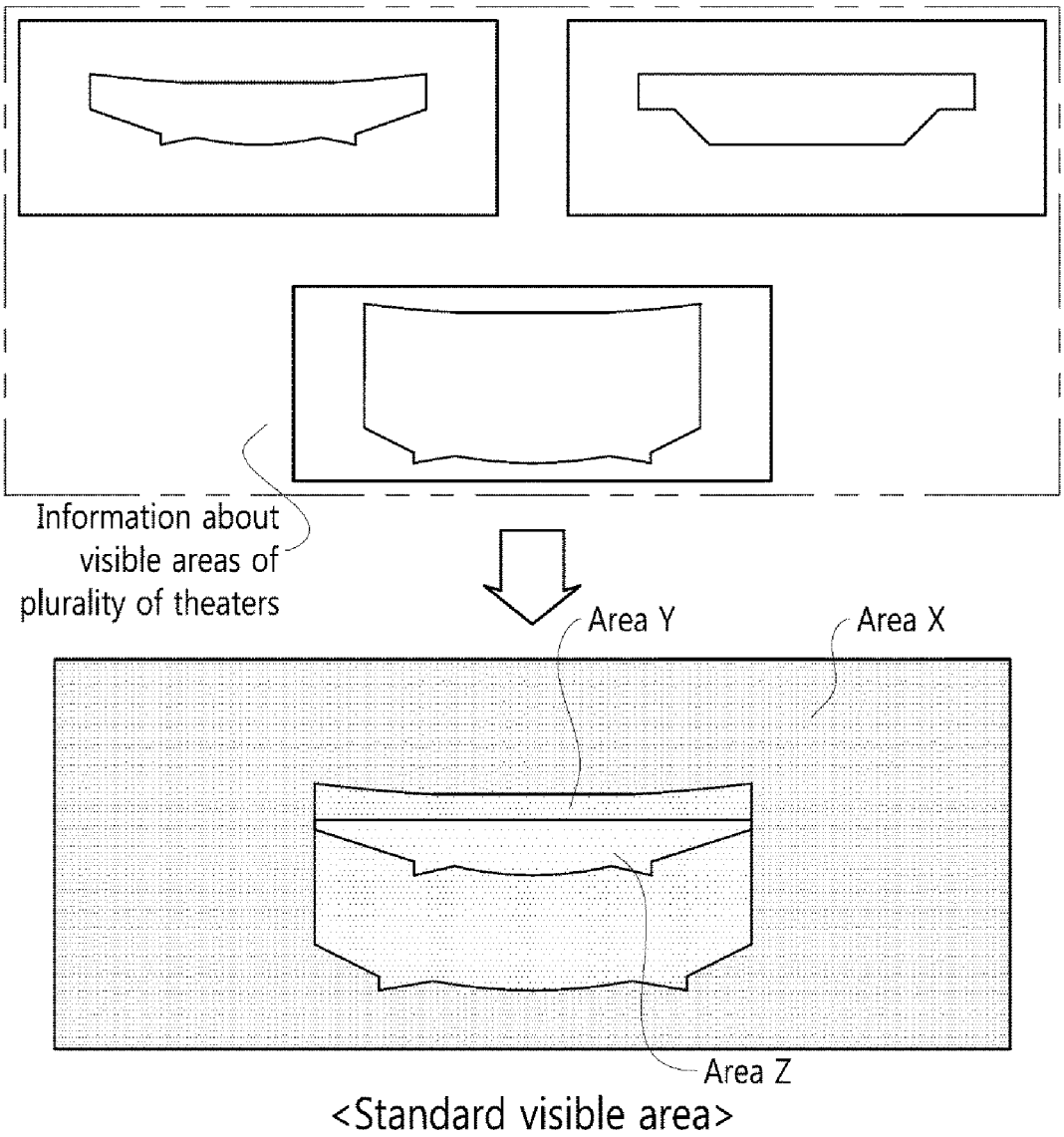
FIG. 7 is a conceptual diagram illustrating that information about a standard visible area is generated based on information about the visible areas of a plurality of theaters.

FIG. 7 illustrates an example of a standard visible area generated by combining pieces of information about the visible areas of a plurality of theaters. As seen from FIG. 7, the standard visible area may be divided into three areas. More specifically, the standard visible area may be divided into an area X, an area Y, and an area Z. The area X means an area always not seen in all the theaters (i.e., an area always classified as an invisible area in all the theaters), the area Y means an area seen only in some of all the theaters (i.e., an area classified as a visible area in part of the theater and classified as an invisible area in the remaining theater). Furthermore, the area X means an area always seen in all the theaters (i.e., an area classified as a visible area in all the theaters).

In an embodiment of the present invention, pieces of information about the visible areas of a plurality of theaters may be integrated and managed using information about such a standard visible area. The pieces of information may become parameters and may be managed. Furthermore, since areas defined as visible areas in all of a plurality of theaters can be clearly specified, they may be used in a process of producing standard content that may be applied to all the theaters.

At step S14, a standard guide image used to produce standard content is generated based on information about a standard visible area generated at step S13.

In this case, the standard guide image means an image to which reference is made in a process of converting specific content into standard content. Such a standard guide image may include pieces of correction information for converting specific content (e.g., advertisement content or movie content) into standard content that may be played back in all of a plurality of theaters. Reference may be made to the standard guide image in a process of converting specific content into standard content so that an image can be easily corrected.

In an embodiment of the present invention, the standard guide image may be generated based on the information about the standard visible area. In particular, the size, resolution, data format, etc. of the standard guide image may be specified based on pieces of information about areas defined as visible areas in all of a plurality of theaters. Accordingly, pieces of content converted based on the standard guide image may satisfy the conditions of standard content (i.e., content that may be played back in all the theaters).

As described above, in an embodiment of the present invention, information about a standard visible area that integrates and represents information about the visible areas of a plurality of theaters may be generated through steps S13 and S14. A standard guide image for generating standard content may be generated based on the information about the standard visible area. Accordingly, an embodiment of the present invention may be used in a process of producing standard content that may be played back in a plurality of theaters.

A theater information management apparatus 100 in accordance with an embodiment of the present invention is described below with reference to FIGS. 8 and 9.

The theater information management apparatus 100 to be described hereinafter in accordance with an embodiment of the present invention is an apparatus for managing information about a theater using the method of representing the visible area of a theater. Accordingly, characteristics described above in connection with the method of representing the visible area of a theater may be derived and applied to the theater information management apparatus 100 in accordance with an embodiment of the present invention although they are not described in detail in order to avoid redundancy.

Figure 8:
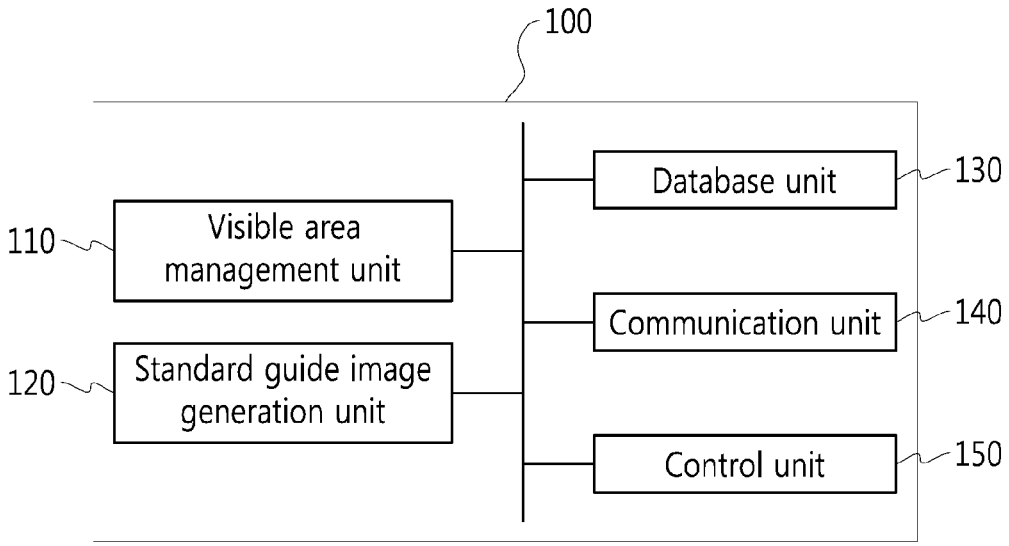
FIG. 8 is a diagram illustrating the configuration of a theater information management apparatus in accordance with an embodiment of the present invention.

Referring to FIG. 8, the theater information management apparatus 100 in accordance with an embodiment of the present invention includes a visible area management unit 110 configured to represent the visible area of a theater based on the value of an angle at which a specific spot is seen from a reference spot within the theater, a standard guide image generation unit 120 configured to generate a standard guide image used to produce standard content based on information about the visible area generated by the visible area management unit 110, a database unit 130 configured to store various data used in the operation of the theater information management apparatus, a communication unit 140 configured to send or receive information, and a control unit 150 configured to control the operation of the theater information management apparatus including the visible area management unit, the standard guide image generation unit, the database unit, and the communication unit.

Furthermore, the theater information management apparatus 100 may further include a user interface unit configured to receive information from a user and a display unit configured to visually display a variety of pieces of information in addition to the aforementioned constituent elements. Such constituent elements may also be controlled by the control unit 150.

The visible area management unit 110 generates information about the visible area of a theater based on the value of an angle at which a specific spot is seen from a reference spot within the theater. The visible area management unit 110 performs a variety of types of operations that are included in the method of representing the visible area of a theater and that are related to the generation of a visible area.

For example, the visible area management unit 110 may generate the value of a first angle seen in a horizontal direction from a reference spot within a theater and the value of a second angle seen in a vertical direction from the reference spot within the theater with respect to spots included in the visible area of each theater. The visible area of the theater may be represented in a coordinate system using the value of the first angle and the value of the second angle as variables. For reference, information about the visible area represented on the coordinate system may be visually displayed through the display unit or may be represented on a variety of types of an electronic device operating in conjunction with the communication unit 140.

Furthermore, the visible area management unit 110 may generate information about a standard visible area based on pieces of information about the visible areas of a plurality of theaters. In this case, the information about the standard visible area may include information about an area always seen in all the theaters, information about an area always not seen in all the theaters, and information about an area seen in only some of all the theaters.

The standard guide image generation unit 120 generates a standard guide image used to produce standard content based on information about a standard visible area generated by the visible area management unit 110. The standard guide image generation unit 120 may perform a variety of types of operations that are included in the method of representing the visible area of a theater and that are related to the generation of a standard guide image.

The database unit 130 stores various data and may be configured to include one or more memory devices.

The database unit 130 may store a variety of pieces of information related to the operation of the theater information management apparatus 100. For example, the database unit 130 may store may store the databased structural data of a theater that is used to generate information about a visible area and may store such structural data according to each of a plurality of theaters. Furthermore, the database unit 130 may match information about the visible area of each of a plurality of theaters with ID information about each theater and store the matched information. The database unit 130 may store information about a standard visible area that is generated based on pieces of information about the visible areas of a plurality of theaters. Furthermore, the database unit 130 may store information about a variety of types of video content (e.g., movie content and advertisement content), a generated standard guide image, and generated standard content.

The communication unit 140 sends or receives data and may be implemented in various forms which include a wired communication device or a wireless communication device.

The communication unit 140 may be connected to a variety of types of electronic devices, including user terminals, the server apparatus of each theater, and a measurement apparatus installed in each theater, in a wired or wireless manner. The communication unit 140 may send and receive a variety of pieces of information through such connection.

The user interface unit receives a variety of pieces of information from a user. The user interface unit may be implemented through cooperation with an input device that is separately configured or may be implemented through cooperation with a user terminal through the communication unit 140.

The user interface unit may be implemented in various Graphic User Interface (GUI) form and may receive a variety of pieces of information including the structural data of each theater.

The display unit displays a variety of pieces of information related to the operation of the theater information management apparatus 100. The display unit may display various visible areas of each theater and may display a computed standard visible area or a standard guide image. Furthermore, the display unit may display generated standard content or the GUI of the user interface unit and may a variety of pieces of information related to the operation of the theater information management apparatus 100 in addition to such pieces of information.

The control unit 150 controls the various constituent elements of the theater information management apparatus 100 which includes the visible area management unit 110, the standard guide image generation unit 120, the database unit 130, the communication unit 140, the user interface unit, and the display unit.

The control unit 150 may include at least one operation element. In this case, the operation element may be a general-purpose Central Processing Unit (CPU), but may be a programmable device (e.g., a Complex Programmable Logic Device (CPLD) or a Field Programmable Gate Array (FPGA)), an Application-Specific Integrated Circuit (ASIC), or a microchip controller that is implemented for a special purpose.

Each of the aforementioned constituent elements may be implemented purely using a hardware or software element or may be implemented through a combination of a variety of types of hardware and software. Furthermore, the constituent elements have been illustrated as being separated for convenience of description, but one or more of the constituent elements may be implemented using the same hardware or software.

Figure 9:
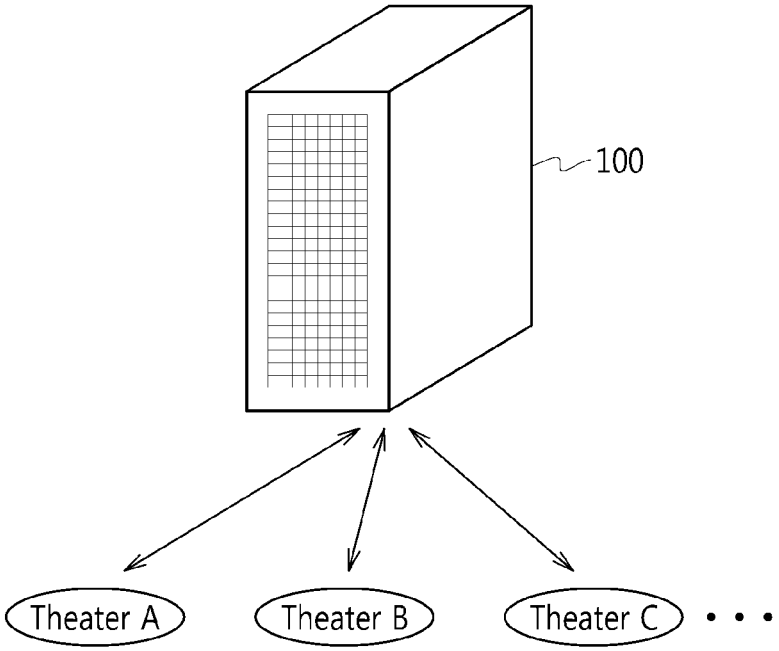
FIG. 9 is an exemplary diagram illustrating that the theater information management apparatus in accordance with an embodiment of the present invention operates in conjunction with a plurality of theaters.

Referring to FIG. 9, the theater information management apparatus 100 in accordance with an embodiment of the present invention may operate in conjunction with screening systems constructed in a plurality of theaters (e.g., a theater A, a theater B, and a theater C) through the communication unit 140 and may perform a variety of types of management operations through such cooperation.

For example, the theater information management apparatus 100 may receive structural information from each theater and generate information about the visible area of each theater (e.g., information about the visible area of the theater A, information about the visible area of the theater B, and information about the visible area of the theater C) based on the received information. In such a case, the theater information management apparatus 100 may receive the structural data of each theater while operating in conjunction with a measurement apparatus installed in the theater or may receive databased structural information from the server of each theater. Furthermore, the theater information management apparatus 100 may sort and database pieces of the received structural information according to each theater and may store and manage the piece of structural information in the database unit 130.

Furthermore, the theater information management apparatus 100 may generate information about a standard visible area by combining pieces of information about the visible areas of theaters, may generate a standard guide image using the information about the standard visible area, and may generate standard content using the standard guide image. Thereafter, the theater information management apparatus 100 may send the generated standard content to the plurality of theaters (e.g., the theater A, the theater B, and the theater C) at once so that the standard content is screened in each of the theaters.

In an embodiment of the present invention, information about the visible area of a theater can become a parameter and can be managed. More specifically, in an embodiment of the present invention, since information about the visible area of each theater can be managed using parameters called the values of angles to a reference spot, information about a visible area can be databased and managed and may be used in a variety of types of operation processes.

Furthermore, in an embodiment of the present invention, information about the visible area of a theater can be visualized and represented. More specifically, in an embodiment of the present invention, information about a visible area can be computed using two parameters, that is, a horizontal angle and a vertical angle to a reference spot, and the computed information can be represented on a coordinate system using the two parameters as independent variables. Accordingly, information about the visible area of a theater can be visualized and managed through such a process.

Furthermore, in an embodiment of the present invention, information about a standard visible area can be computed by combining pieces of information about the visible areas of a plurality of theaters. Accordingly, pieces of information about the visible areas of a plurality of theaters can be integrated and managed using such information about the standard visible area.

Furthermore, in an embodiment of the present invention, a standard guide image used to produce standard content can be generated using information about a standard visible area. More specifically, in an embodiment of the present invention, a standard guide image that covers all of a plurality of theaters can be generated using information about a standard visible area. Standard content that can be played back in all of the plurality of theaters can be generated on the standard guide image.

The aforementioned embodiments of the present invention have been disclosed for illustrative purposes, but the present invention is not restricted by the embodiments. Furthermore, those skilled in the art to which the present invention pertains may modify and change the present invention in various ways within the spirit and scope of the present invention, and such modifications and changes should be construed as falling within the scope of the present invention.

What is claimed is:

1. A method of representing each visible area of a plurality of theaters, the method performed by a processor of theater information management apparatus the method comprising:

measuring, by a measurement apparatus of the theater information management apparatus, angles formed by a reference spot in each theater of the plurality of theaters and a specific spot in the each visible area of the plurality of theaters;

generating visible area information on the each visible area of the plurality of theaters based on the measured angles;

generating standard visible area information based on the generated visible area information; and generating a standard guide image based on the generated standard visible area information, in order to produce standard content, wherein the standard visible area information comprises information on a first area measured at the reference spot in the plurality of theaters, a second area failed to measure at the reference spot in the plurality of theaters, and a third area only measured at the reference spot in a theater among the plurality of theaters.

2. The method of claim 1, wherein the measuring of angles comprises:

measuring, in horizontal direction, a first angle formed by a reference line between the reference spot and a center of a projection surface in each theater of the plurality of theaters and the specific spot; and measuring, in vertical direction, a second angle formed by the reference line in each theater of the plurality of theaters and the specific spot.

3. The method of claim 2, wherein the measured first angle is a value belonging to a range of −180 degrees to 180 degrees, and the measured second angle is a value belonging to a range of −90 degrees to 90 degrees.

4. The method of claim 2, wherein the each visible area is generated based on the measured first angle and second angle.

5. The method of claim 1, wherein the each theater of the plurality of theaters comprises a plurality of projection surfaces.

6. A non-transitory computer-readable storage medium storing a program for implementing a method of representing each visible area of a plurality of theaters, the method executed by a processor of theater information management apparatus, the method comprises:

measuring, by a measurement apparatus of the theater information management apparatus, angles formed by a reference spot in each theater of the plurality of theaters and a specific spot in the each visible area of the plurality of theaters;

generating visible area information on the each visible area of the plurality of theaters based on the measured angles;

generating standard visible area information based on the generated visible area information; and generating a standard guide image based on the generated standard visible area information, in order to produce standard content, wherein the standard visible area information comprises information on a first area measured at the reference spot in the plurality of theaters, a second area failed to measure at the reference spot in the plurality of theaters, and a third area only measured at the reference spot in a theater among the plurality of theaters.

7. A theater information management apparatus for managing information on a plurality of theaters, comprising: a measurement unit configured to measure angles formed by a reference spot in each theater of the plurality of theaters and a specific spot in each visible area of the plurality of theaters; a visible area management unit configured to generate visible area information on the each visible area of the plurality of theaters based on the measured angles, and standard visible area information based on the generated visible area information; and a standard guide image generation unit configured to generate a standard guide image based on the generated standard visible area information, in order to produce standard content, wherein the standard visible area information comprises information on a first area measured at the reference spot in the plurality of theaters, a second area failed to measure at the reference spot in the plurality of theaters, and a third area only measured at the reference spot in a theater among the plurality of theaters.

8. The theater information management apparatus of claim 7, wherein the measurement unit is configured to:

measure, in horizontal direction, a first angle formed by a reference line between the reference spot and a center of a projection surface in each theater of the plurality of theaters and the specific spot; and measure, in vertical direction, a second angle formed by the reference line in each theater of the plurality of theaters and the specific spot.

9. The theater information management apparatus of claim 8, wherein the visible area management unit is configured to generate the each visible area based on the measured first angle and second angle.

* * * * *